US010799014B2

(12) United States Patent
Binnington

(10) Patent No.: US 10,799,014 B2
(45) Date of Patent: Oct. 13, 2020

(54) FLEXIBLE HAIR BRUSH

(71) Applicant: T & D PARTNERSHIP LIMITED, Hayes Middlesex (GB)

(72) Inventor: Tim Binnington, Thames Ditton (GB)

(73) Assignee: MANTA HAIR LIMITED, Hayes Middlesex (GB)

( * ) Notice: Subject to any disclaimer, the term of this patent is extended or adjusted under 35 U.S.C. 154(b) by 213 days.

(21) Appl. No.: 15/746,234

(22) PCT Filed: Jul. 20, 2016

(86) PCT No.: PCT/GB2016/052201
§ 371 (c)(1),
(2) Date: Jan. 19, 2018

(87) PCT Pub. No.: WO2017/013430
PCT Pub. Date: Jan. 26, 2017

(65) Prior Publication Data

US 2018/0206626 A1 Jul. 26, 2018

(30) Foreign Application Priority Data

Jul. 20, 2015 (GB) ..... 1512715.2

(51) Int. Cl.
*A46B 3/20* (2006.01)
*A46B 5/00* (2006.01)
(Continued)

(52) U.S. Cl.
CPC ..... *A46B 9/023* (2013.01); *A46B 3/20* (2013.01); *A46B 5/0025* (2013.01);
(Continued)

(58) Field of Classification Search
CPC ..... A46B 9/023; A46B 3/20; A46B 5/0025; A46B 5/0029; A46B 2200/104
See application file for complete search history.

(56) References Cited

U.S. PATENT DOCUMENTS 6,006,395 A * 12/1999 Tiramani ..... A46B 5/0025 15/176.1
6,088,870 A * 7/2000 Hohlbein ..... A46B 9/10 15/167.1
(Continued)

FOREIGN PATENT DOCUMENTS

GB 1309029 A 3/1973
GB 2457325 A 8/2009
(Continued)

OTHER PUBLICATIONS

International Search Report and Written Opinion of the International Search Authority (forms PCT/ISA/220, PCT/ISA/210, and PCT/ISA/237) for International Application No. PCT/GB2016/052201 dated Sep. 29, 2016 (10 pages).
(Continued)

*Primary Examiner* — Randall E Chin
(74) *Attorney, Agent, or Firm* — Withrow & Terranova, P.L.L.C.; Vincent K. Gustafson

(57) ABSTRACT

There is herein provided a hair brush comprising a body portion formed from a material having a first flexibility; and a bristle mount formed from a material having a second, lesser, flexibility, coupled to the body portion, the bristle mount comprising a plurality of mount sections, each mount section having at least one bristle mounted thereon, wherein the mount sections are movable relative to one another in three dimensions such that the relative flexibility of the overall bristle mount is greater than the second flexibility, thereby enabling the bristle mount to substantially replicate bending or flexing of the body portion. Such a brush is highly flexible yet effective and may be easily adapted or shaped by a user to conform to the contours of, for example, a head or body.

18 Claims, 8 Drawing Sheets

(51) Int. Cl.

| | |
|---|---|
| ***A46B 9/02*** | (2006.01) |
| ***A46B 5/02*** | (2006.01) |
| ***A46B 7/02*** | (2006.01) |
| ***A46B 7/04*** | (2006.01) |

(52) U.S. Cl.
CPC ..... *A46B 5/0029* (2013.01); *A46B 5/021* (2013.01); *A46B 7/023* (2013.01); *A46B 7/04* (2013.01); *A46B 2200/104* (2013.01)

(56) References Cited

U.S. PATENT DOCUMENTS

| | | | | |
|---|---|---|---|---|
| 2004/0255967 | A1 | 12/2004 | White et al. | |
| 2005/0066462 | A1* | 3/2005 | Moskovich ..... | A46B 3/20 15/167.1 |
| 2011/0167580 | A1 | 7/2011 | Mercier | |
| 2014/0373294 | A1 | 12/2014 | Schuster | |

FOREIGN PATENT DOCUMENTS

| | | | |
|---|---|---|---|
| JP | 2000-139567 | A | 5/2000 |
| WO | 2007-092016 | A1 | 8/2007 |

OTHER PUBLICATIONS

Search Report under Section 17(5) for United Kingdom Patent Application No. GB1512715.2 dated Jan. 15, 2016 (3 pages).
First Search Report for Chinese Patent Application No. 2016800545195, dated Apr. 25, 2019, 2 pages.
First Office Action for Chinese Patent Application No. 2016800545195, dated May 7, 2019, 15 pages.
International Preliminary Report on Patentability for International Patent Application No. PCT/GB2016/052201, dated Feb. 1, 2018, 7 pages.

* cited by examiner

FLEXIBLE HAIR BRUSH

CROSS-REFERENCE TO RELATED APPLICATIONS

This application is a 35 U.S.C. § 371 national phase filing of International Application No. PCT/GB2016/052201 filed Jul. 20, 2016, and claims the benefit of United Kingdom Patent Application No. 1512715.2 filed Jul. 20, 2015. The entire disclosures of the foregoing applications are hereby incorporated by reference herein, in their respective entireties.

FIELD OF INVENTION

The invention relates to the field of hair brushes.

BACKGROUND TO THE INVENTION

Hair brushes are well known in the prior art and are commonly used, for example, to detangle knots and other obstructions from hair. Typical hair brushes comprise a plurality of bristles mounted in a panel or paddle, the bristles being adapted to penetrate hair so as to enable brushing of the hair.

Conventional hair brushes consist of a handle with a panel mounted at one end. The handle is typically gripped by a user in a fist-like or closed grip configuration so as to enable control of the panel to brush the hair.

Palm-held hair brushes are known to provide an improved level of control for brushing of hair. Such palm-held hair brushes are typically adapted to be held substantially against a user's open palm and optionally fingers. Some known palm-held hair brushes comprise, for example, a strap for securing the brush to the hand.

SUMMARY OF THE INVENTION

The invention is defined by the claims.

According to a first aspect of the invention, there is provided a hair brush comprising a body portion formed from a material having a first flexibility; and a bristle mount formed from a material having a second, lesser, flexibility, coupled to the body portion, the bristle mount comprising a plurality of mount sections, each mount section having at least one bristle mounted thereon, wherein the mount sections are movable relative to one another in three dimensions such that the relative flexibility of the overall bristle mount is greater than the second flexibility, thereby enabling the bristle mount to substantially replicate bending or flexing of the body portion.

In other words, there is herein provided the concept of a hair brush comprising a body portion formed from a material having a first elastic modulus and a bristle mount formed from a material having a second elastic modulus. The first elastic modulus is less than the second elastic modulus. In other words a material of the body portion is more flexible or less stiff than a material of the bristle mount.

The elastic modulus is a property of a material that is independent of the structure formed from the material. The elastic modulus may be the material's Young's modulus or tensile modulus so as to provide an indication of the rigidity or stiffness of the intrinsic material. Conventionally, the lower the elastic modulus, the more elastic or intrinsically deformable a material is.

The bristle mount comprises a plurality of mount sections wherein each mount section may have a changeable position in three-dimensional space relative to a neighbouring or adjacent mount section. A mount section may thus be understood to be a portion of the bristle mount which may have a range of independent movement from other portions of the bristle mount. Movement of one mount section does not necessarily cause movement of all mount sections.

In embodiments, a mount section may be moved up, down, left or right relative to the position of a neighbouring mount section. Such a mount section may also be advantageously tilted or angled relative to a neighbouring mount section or be turned or rotated relative to a neighbouring mount section. In other words, the mount section may be movable in different orientations relative to a neighbouring section, and may therefore rotate, relative to a neighbouring section, in any arbitrary axis.

The movement of the mount sections relative to one another allows for an increase in the flexibility of the overall bristle mount, thereby allowing the bristle mount to bend and flex together with the less stiff, and therefore more deformable and flexible, body portion. In other words, the movability of the mount sections in three dimensions relative to one another allows a bending or twisting movement of the more flexible body portion to be at least partially mirrored or simultaneously reproduced by the bristle mount. The segmenting of the bristle mount into a plurality of mount sections in the manner herein described therefore allows the bristle mount a greater and more flexible range of movement than a non-segmented bristle mount of the same material.

In embodiments, each mount section may have restricted movement in certain directions of movement, for example, a mount section may only be freely movable within a certain distance of a neighbouring mount section.

Bristles are mounted on or in the bristle mount, such that each mount section is associated with at least one bristle.

The invention thereby provides a highly flexible yet effective hair brush, which may be adapted or shaped by a user to conform to the contours of, for example, a head or body. A hair brush according to an embodiment of the invention may thus allow a user to brush more hair simultaneously when compared to a conventional hair brush. Such a hair brush may thereby allow for increased speed and efficiency of brushing hair.

In an embodiment, the hair brush is adapted wherein each mount section is connected to at least one neighbouring mount section by a flexible member.

In other words the bristle mount may be articulated, such that the bristle mount comprises a plurality of mount sections or mounting segments connected by a flexible joint, beam, limb or member. A mount section may therefore be connected to a neighbouring or adjacent mount section by such a flexible or bendable member, such that a mount section may be angled or flexed relative to at least one adjoining mount section. Preferably, the flexible member is formed from the same material as the mount section, such that the entire bristle mount is formed from the same material.

The flexible member allows each mount section freedom to move relative to a neighbouring mount section in three dimensions. The flexible member may be represented as a flexible beam connecting two mount sections together, such that the flexible beam is more flexible than the connected mount sections. The flexible member or beam may be more flexible due to a smaller width (compared to, for example, a surface of a connected mount section) or thickness (compared to a thickness of the mounting section). This thereby allows a bristle mount an increased overall flexibility, greater than the intrinsic flexibility of the material from which the bristle mount is formed.

Optionally, the hair brush further comprises a gap positioned between each pair of neighbouring mount sections connected by a flexible member, such that each flexible member spans a gap between two neighbouring mount sections, thereby enabling the said mount sections to be positioned about one another.

The separation by a gap or aperture allows each mount section a greater maneuverability relative to one another (e.g. allowing for a greater angle of rotation around one another).

Preferably, the hair brush is adapted wherein: the plurality of mount sections are arranged into at least one row; each mount section comprises an outwardly facing surface area, the outwardly facing surface area being the area of the mount section upon which the at least one bristle is mounted, wherein each outwardly facing surface area is similarly shaped; and outwardly facing surface areas of mount sections in the same row are alternately oriented.

In other words the plurality of mount sections may be arranged or grouped into at least one set of mount sections, each mount section in a respective set being positioned side-by-side or otherwise adjacent to one another, thereby defining a row. In such embodiments, each mount section may have an outwardly surface area or face, the said surface area having bristles mounted thereon. Bristles mounted on an outwardly facing surface area may point away from the body portion, and hence an outwardly facing surface area is typically not directly coupled to the body portion.

The said surface areas of respective mount sections in the same row may be understood to be oriented in one of two angles of rotation relative to an axis normal to a length of the row. Along the said length of a row, the surface areas may be alternately oriented, such that the surface areas of adjacent mount sections in the row are not oriented to the same angle.

Each relative position of the two possible angles of rotation may also, in embodiments, be associated with an offset or translation element in a different axis perpendicular to the length of the row, such that alternate surface areas are subject to a change in position and rotation along the length of the row. In other words, mount sections in a row may be alternately offset relative to the length of the row.

There may be perimeter edges of the outwardly facing surface area that demarcate a geometric shape. In other words, a geometric shape may be defined by the edges of the outwardly facing surface area. The geometric shapes of the mount sections are preferably, although not essentially, either similar or identical.

Such a hair brush may be further adapted wherein: the plurality of mount sections are arranged into a plurality of rows, each row comprising a plurality of mount sections; each mount section is connected to each neighbouring mount section in a respective row by a flexible member; and each mount section in a row is connected to at least one mount section in a neighbouring row.

In other words, there may be defined a plurality of rows, wherein the mount sections of any given row are interconnected by at least one flexible member, such that the rows of mount sections may be movable relative to one another in three dimensions. Each mount section in a row is connected by a flexible member such that each mount section in a row may be movable relative to adjacent or neighbouring mount sections in that said row.

The hair brush may be further adapted wherein: the outwardly facing surface area of each mount section is triangularly shaped; each mount section is connected to connected to only three other mount sections by a respective flexible member; and each flexible member extends from a respective vertex of the outwardly facing surface area.

In such an embodiment the mount sections of the bristle mount are triangular, thereby having three vertices. A flexible member extends from or is coupled to each vertex to connect to a neighbouring mount section. There are, therefore, three flexible members associated or in contact with any given mount section.

In an embodiment the hair brush is adapted wherein each bristle in the plurality of bristles is formed from a material having a third flexibility, the third flexibility being less than or equal to the second flexibility.

In other optional embodiments the bristles are formed together with the bristle mount such that the bristles are formed from the same material as the bristle mount.

The plurality of bristles optionally comprises groups of at least one bristle, wherein the tips of bristles in a same respective group lie in the same plane and the tips of bristles in different groups lie in different planes.

It will be understood that the tip of a bristle is that end or extremity of the bristle not mounted in the bristle mount. That is, the bristle may be modelled as a cantilever, having a first end fixed in the bristle mount, and a second end free to move, wherein the second end is the tip.

It will be clear to the skilled person that in such embodiments each bristle in a group of bristles need not be the exact same length, as long as each bristle in a group lies in the same plane. In preferable embodiments, the tips of bristles in neighbouring or adjacent groups are in different planes.

The hair brush may be adapted wherein: the body portion comprises at least one of the following materials: silicone; thermoplastic elastomer, rubber; and elastomer; and the bristle mount comprises at least one of the following materials: thermoplastic elastomer, nylon and thermoplastic.

The body portion may be formed so as to enable a user of the hair brush to hold the hair brush in the palm of a hand. This thereby enables the hair brush to be advantageously palm-held, which increases the level of control a user may have over the hair brushing action.

Palm-held should be understood to mean that, in use, the hair brush is designed to rest or lie substantially against a user's open palm and optionally digits. In other words, the hair brush is held in a cupped, open or unclenched configuration of the hand. Thus, in use, a user's fingers do not curl wholly around a portion of hair brush (e.g. a handle) to grasp or grip the said portion of the hair brush. During use of the hair brush a user's digits do not point towards the palm of the user's hand (i.e. a user's hand is not in a closed or clenched configuration), rather a user's fingers point away from the palm of a user's hand (i.e. a user's hand is in an open or unclenched configuration). It may therefore be understood that a fist-like shape is not formed by a user's hand during the conventional use of a palm-held hair brush.

The body portion of such a palm-held hair brush may further comprise a gripping protrusion, the gripping protrusion having a profile shaped to fit between a user fingers when the body portion rests against a user's palm.

A gripping protrusion according to an embodiment thereby allows for a more secure palm-held hair brush. Such a protrusion may be understood to be an outthrust or protuberance from a surface of the body portion, wherein the protrusion has a shape adapted to be positioned between a first selected finger and a second selected finger of a user's hand (i.e. the protrusion fills the space between a first and second finger). The protrusion is preferably sized such that, when gripped between the said first and second finger, a substantial remainder of the body portion lies against the palm and optionally fingers of the hand.

The body portion of a palm-held hair brush may comprise a first shaped area and a second shaped area, the first shaped area being adapted to have a profile to fit a user's thumb when the body portion rests against a user's palm, the second shaped area having a profiled adapted to fit a user's finger when the body portion rests against a user's palm.

BRIEF DESCRIPTION OF THE DRAWINGS

Examples of the invention will now be described in detail with reference to the accompanying drawings, in which.

DETAILED DESCRIPTION

Figure 1:
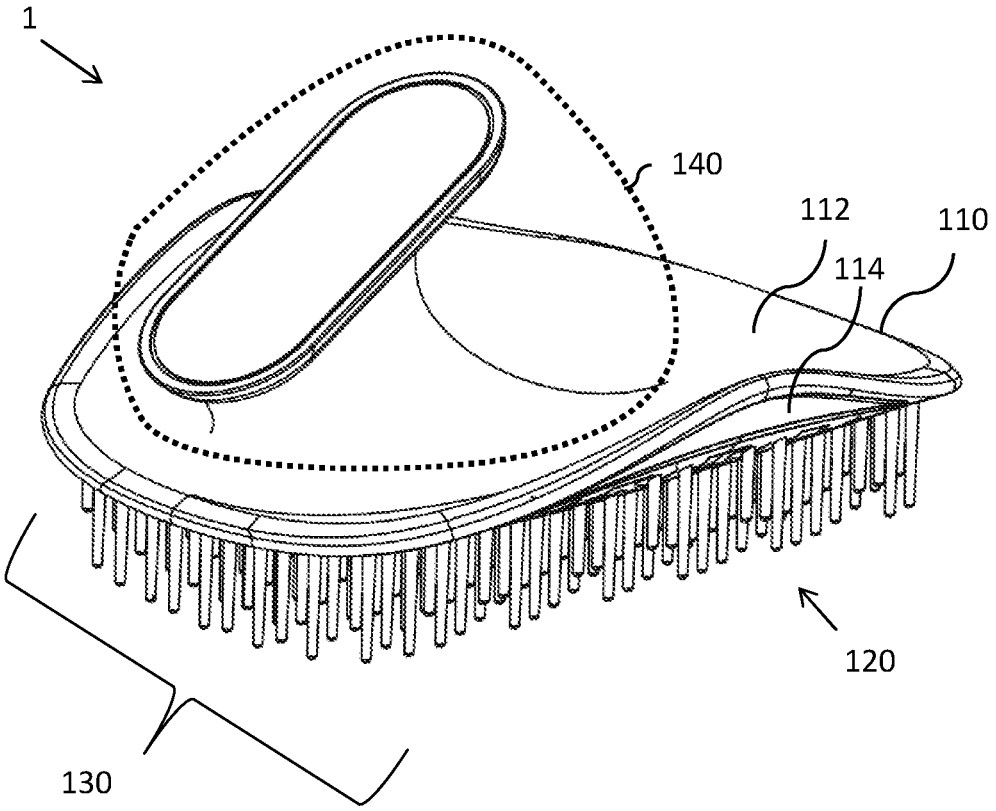
FIG. 1 illustrates an isometric view of a hair brush according to a first embodiment of the invention.

The invention relates to the concept of a hair brush having at least two portions, a body portion and a bristle mount having bristles mounted thereon. The body portion is formed from a first material having a first rigidity or intrinsic stiffness and the bristle mount is formed from a second material having a second rigidity or intrinsic stiffness. The rigidity of the first material is less than the rigidity of the second material, such that the intrinsic flexibility of the first material is greater than the intrinsic flexibility of the second material. The bristle mount comprises a plurality of mount sections, each mount section adapted to be positioned about one another so as to allow the bristle mount to substantially replicate the bending of the less stiff body portion.

Although embodiments described below relate to advantageous embodiments of palm-held hair brushes, it will be readily apparent that in other embodiments the hair brush is a 'conventional' hair brush, comprising a handle to be gripped by a user.

It should be understood that the Figures are merely schematic and are not drawn to scale. It should also be understood that the same reference numerals are used throughout the Figures to indicate the same or similar parts.

Figure 2:
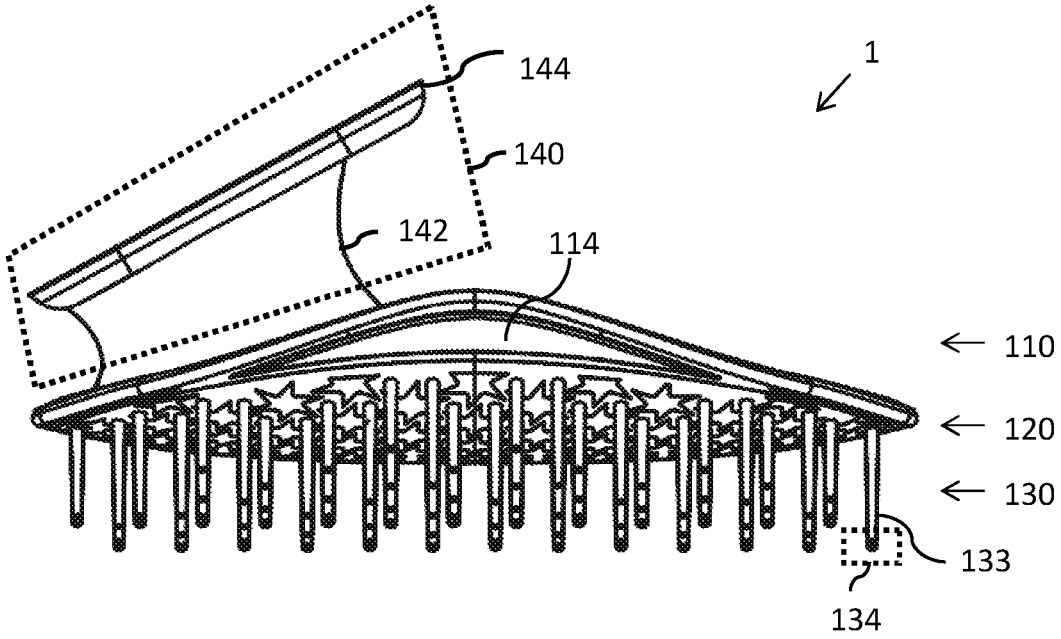
FIG. 2 illustrates a side view of the hair brush according to the first embodiment of the invention.
Figure 3:
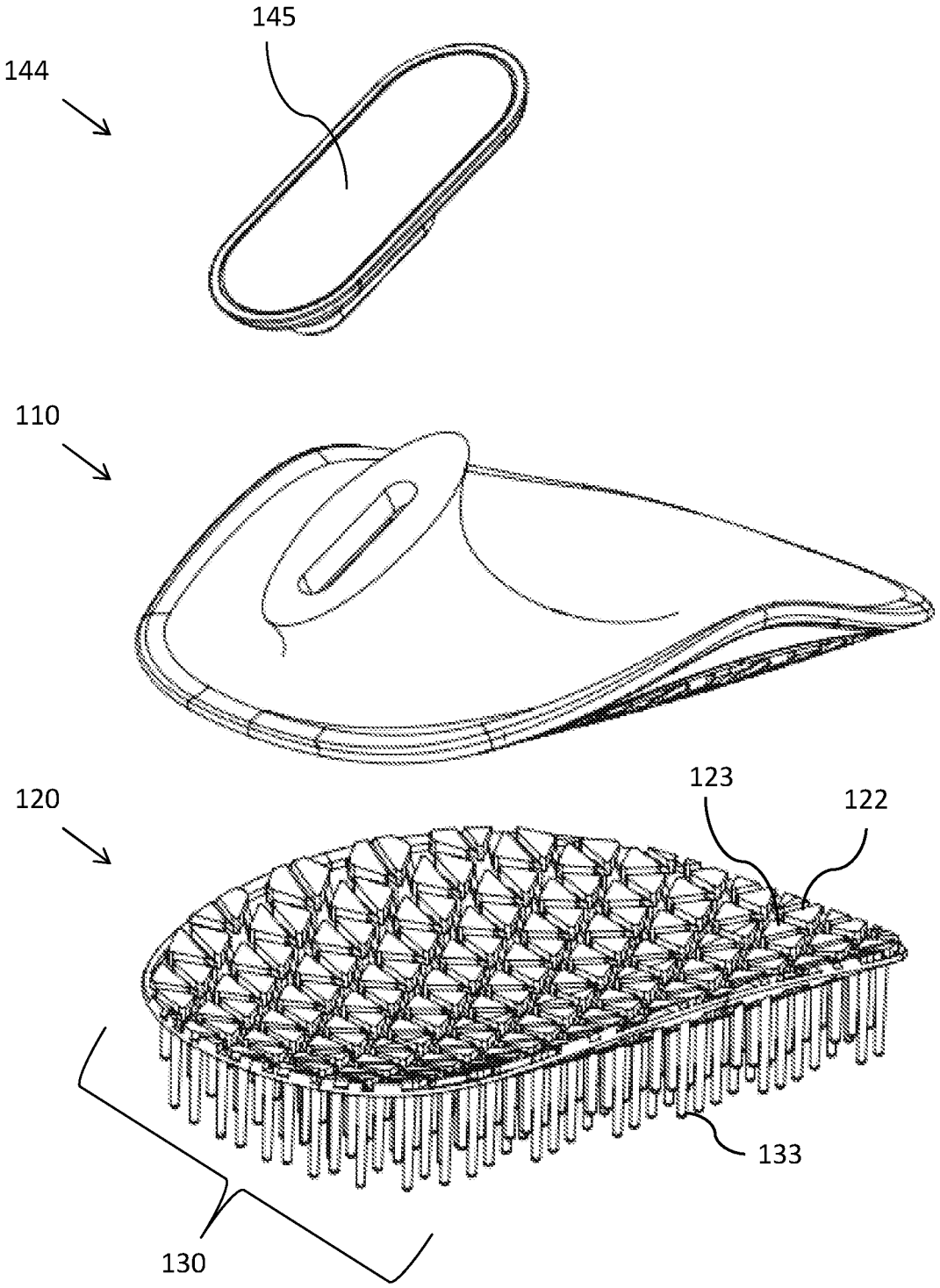
FIG. 3 illustrates an exploded isometric view of the hair brush according to the first embodiment of the invention.

The basic structure of a palm-held hair brush according to a first embodiment of the invention may be readily described with reference to FIGS. 1-3. FIGS. 1 and 2 provide an isometric view and a side view respectively of a palm-held hair brush 1 according to the first embodiment of the invention. FIG. 3 identifies an exploded diagram of the isometric view provided by FIG. 1.

The hair brush 1 comprises a body portion 110 and a bristle mount 120 coupled together. Mounted on the bristle mount 120 is a plurality of bristles 130. A handle 140 is coupled to the body portion, the handle comprising a gripping protrusion 142, formed as part of the body portion 110, and a stopping portion 144 that includes a body 145 illustrated as having a rounded rectangular shape.

The body portion 110 is adapted to rest against a user's palm, such that a user may hold the body portion in a cupped hand. Specifically, the body portion is shaped so as to have a top surface 112 having a profile which fits against a user's palm. For example, the body portion may resemble a paraboloid (e.g. a hyperbolic paraboloid), such that the top surface 112 of the body portion is contoured to fit a user's cupped hand.

The bristle mount 120 is coupled to the body portion 110 such that an inwardly facing surface of the bristle mount 120 is positioned to face a surface of the body portion 110. The faces may be directly coupled together such that the surface of the bristle mount is in full contact with the surface of the body portion, or may be connected only at perimeter edges of the respective surfaces (e.g. by glue). Other methods of connecting the body portion to the bristle mount will be readily known to a person skilled in the art.

The body portion 110 is formed of a first material having a first elastic modulus (e.g. tensile modulus or Young's modulus). The bristle mount 120 is formed from a second material having a second elastic modulus. The first elastic modulus is lower than the second elastic modulus such that, on the whole, the first material is more flexible or less rigid than the second material.

By way of example, the body portion may be formed from silicone rubber (having a Young's modulus of around 0.001-0.050 GPa), whereas the bristle mount may be formed from nylon (having a Young's modulus of around 2-4 GPa). Thus, the body portion may have a greater intrinsic flexibility than the bristle mount.

The bristle mount 120, coupled to the body potion 110, comprises a plurality of mount sections 122 which are adapted to be movable in three-dimensions relative to one another. In other words, each mount section of the bristle mount may be positioned about an adjacent mount section.

This ability of the mount sections to be positioned about one another allows for the overall bristle mount to at least partially replicate a bending or flexing of the body portion.

In other words, when the body portion 110 is in a rest position and is not subject to a user's bending of flexing, a surface of the bristle mount 120 faces or is wholly in contact with a surface of the body portion 110. Thus a surface of each mount section 122 may be thought to face (e.g. be wholly in contact with) a respective portion of a surface of the body portion. In other words, there may be considered to be an inwardly-facing (toward the body portion) surface of each mount section. As the body portion is bent or flexed, each mount section may position itself relative to adjacent mount sections so as to continue facing its respective portion of the surface of the body portion. Thus, the overall bristle mount may replicate a bending of the body portion.

The ability of the mount section to be angularly positioned relative to one another (i.e. bend about one another) permits bristles mounted thereon to 'lean' away from one another. Thus, for example, if in use, the bristles encounter an obstruction (e.g. a knot or snag in the hair) the bristles may lean individually away from one another (e.g. change the angle between pairs of bristles), rather than bending. This has been advantageously shown to improve the detangling action of a hair brush.

Furthermore, as the bristles may lean away from obstructions, an improvement in the comfort of a user undergoing brushing is realised, as the bristles are less likely to be caught in such obstructions. An additional benefit of the brush is that of providing a massaging effect, as the flexibility of the body portion and the bristle mount allows the brush to match the contours of a user's skin or scalp. This is particularly advantageously in providing an improved hair brushing experience for a head of a person.

By ensuring that the rigidity (i.e. elastic modulus) of the material of the bristle mount is greater than that of the body portion, the hair brush may advantageously allow for sufficiently stiff bristles that improve the brushing of hair.

By way of explanation, the outwardly facing surface of the bristle mount 120 may be modelled as a polygon mesh, where each face of the mesh is a mount section. In other words, when the body portion is flexed, each mount section need not flex in and of itself, but rather be angularly positioned relative to a neighbouring mount section so as to allow the overall bristle mount to substantially replicate a bending of the body portion 110. Thus the bristle mount 120 may not fully replicate the exact form of a flexed body portion 110, but rather reproduce or simulate the effect of such bending or flexing.

Each mount section 122 of the hair brush 1 mounts a bristle 133. Thus at least one bristle is mounted or coupled to each mount section of the hair brush, thereby enabling a plurality of bristles 130 to be mounted on the hair brush.

A bristle 133 may thereby be modelled as a cantilever, anchored at a first end to a mount section 122 of the bristle mount 120. A second, opposite end of the bristle is considered to be the tip 134 of the bristle 133.

In preferable embodiments, the bristle mount 120 and the bristles 130 are formed from the same material and may, for example, be manufactured together in a single moulding or printing process. In at least one other embodiments, the bristles 130 are formed from a third material having a third elastic modulus, the third elastic modulus being greater than the second elastic modulus, such that the bristle material is more rigid than the bristle mount material.

The hair brush 1 further comprises a handle 140, where the handle comprises a gripping protrusion 142 of the body portion 110 and a stopping portion 144. Thus the handle may be thought to be at least partially formed as part of the body portion 110.

The gripping protrusion 142 is shaped so as to fit between the fingers of a user, such that a user may grip the hair brush 1 by squeezing the gripping protrusion 142. This may advantageously improve the amount of grip a user has on the hair brush, permitting a greater amount of control over the hair brush.

The stopping portion 144 is adapted to prevent a user's fingers from slipping off the gripping protrusion 142, and may contribute to the holding of the hair brush 1. For example, the stopping portion 144 may be positioned so as to press against the back of a user's fingers, such that a user's fingers may fit between the stopping portion 144 and the body portion 110 so as to improve the grip of the hair brush.

During other, atypical, usage of the hair brush 1, a user may instead hold the hair brush solely by the handle 140, such that the handle is the only aspect of the hair brush physically gripped by the user. In such usage, the handle may be instead held in a precision grip (i.e. held by a user's fingertips). In at least one embodiment, there may be positioned on an upper surface of the stopping portion 144 a design (for example, an engraved logo or an embossed name).

It will be apparent that the handle 140 of the hair brush 1 is merely an optional feature, and a user may instead be able to grip the hair brush solely in a cupping motion.

The body portion of the hair brush may be further shaped so as to provide at least one additional gripping surface 114. A user may grip such additional gripping surface with a digit, for example a thumb or finger, so as to provide additional support for the holding of the hair brush. There may be at least two such additional gripping surfaces, positioned on opposite sides of the body portion 110. Provision of at least two such additional gripping surfaces would allow a user to squeeze the body portion between two digits, for example between a finger and a thumb, whilst resting the body portion against the palm of the hand, so as to improve the grip and control of the hair brush.

Figure 4:
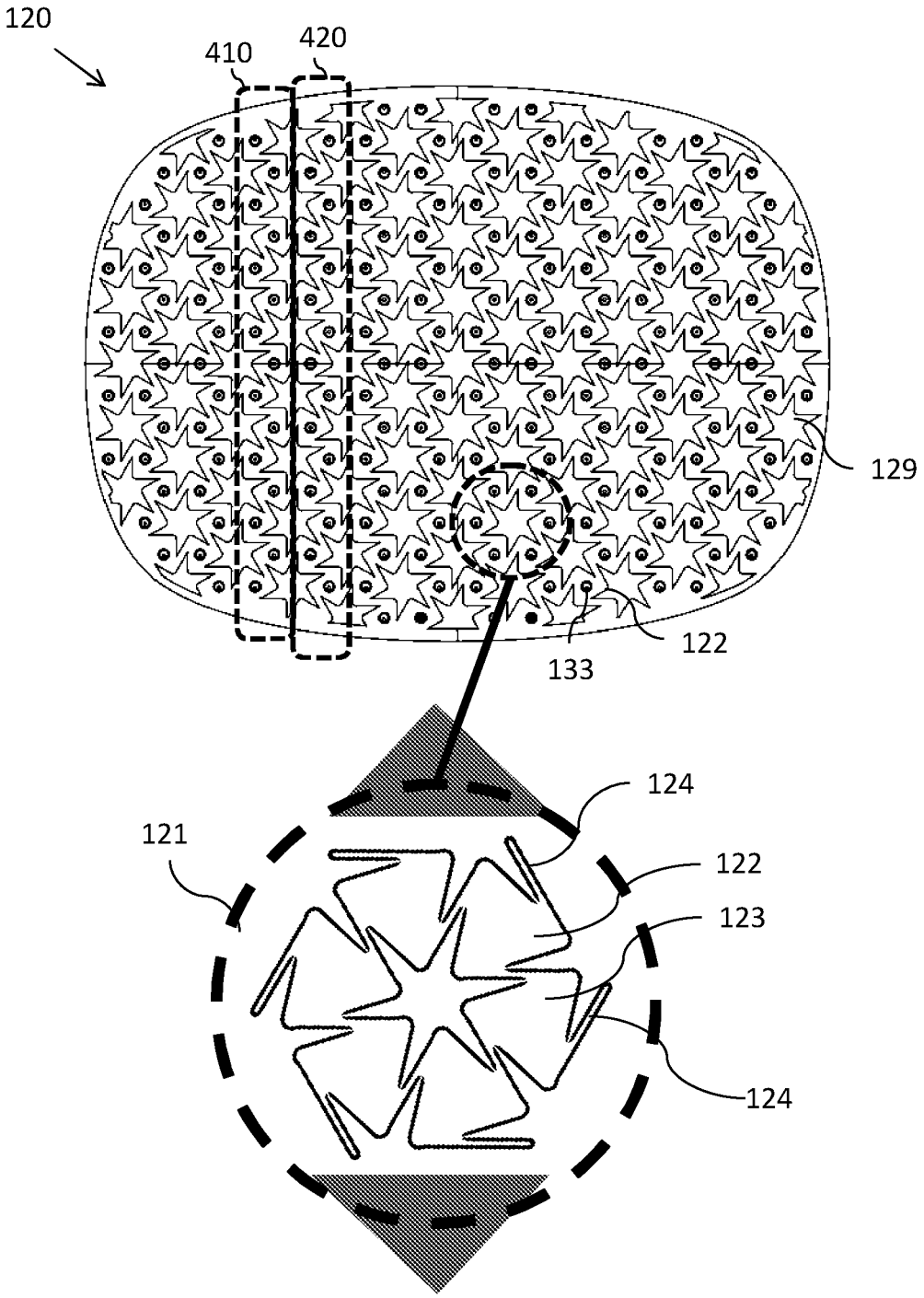
FIG. 4 depicts a view of the outwardly facing surface of the bristle mount of the hair brush according to the first embodiment of the invention.
Figure 5:
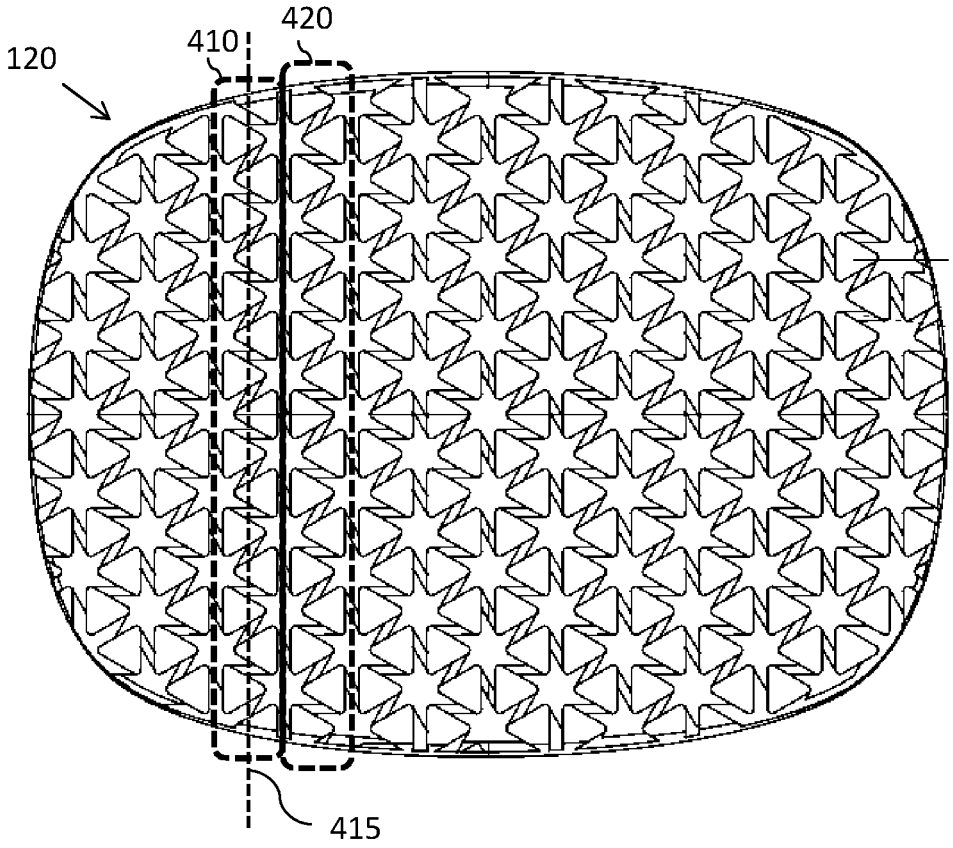
FIG. 5 shows a representative view of the inwardly facing surface of the bristle mount according to the first embodiment of the invention.
Figure 6:
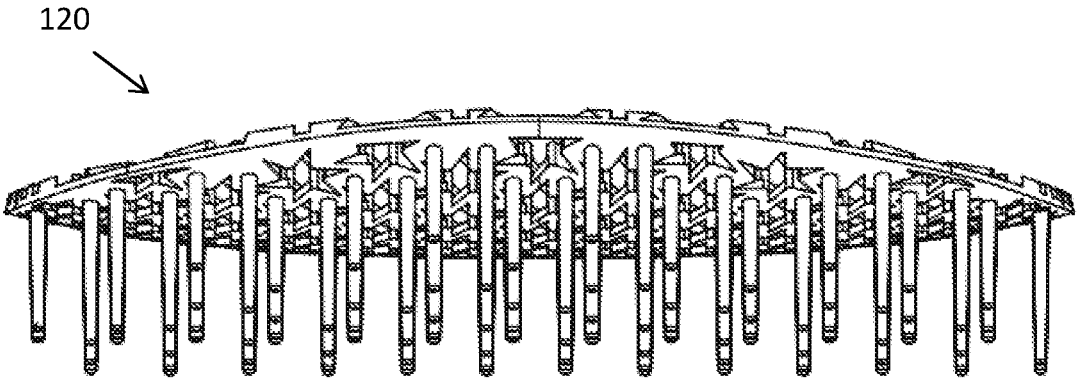
FIG. 6 depicts a side view of the bristle mount according to the first embodiment of the invention.

A skilled person would readily realise other additional grip-assisting features that the hair brush may comprise. For example, the hair brush may comprise a strap for securing the hair brush to a user's hand (e.g. passing over the back of a user's hand). In other examples, the hair brush may comprise a glove-like component positioned to connect to the body portion, wherein a user's hand may fit within the glove-like component so as to secure the hair brush. A bristle mount according to a second embodiment of the invention may be described with reference to FIGS. 4-6. FIG. 4 illustrates an outwardly-facing surface of the bristle mount 120, identifying a view from the base of the hair brush 1 (i.e. looking down the length of the bristles 130). FIG. 5 illustrates an inwardly-facing surface of the bristle mount 120 (i.e. illustrating a view of the surface of the bristle mount facing the body portion). FIG. 5 illustrates a side view of the bristle mount 120.

In order to allow the mount sections 122 of the bristle mount 120 to be positionable about one another, each mount section may be connected to at least one neighbouring mount section 122 by a flexible member 124. The flexible member is adapted to be sufficiently flexible so as to allow the mount section 122 to be angularly positioned about a neighbouring mount section 123.

In other words, a mount section may be flexibility connected to a neighbouring mount section by a beam or limb. Such a beam or limb is more flexible then the connected mount section, thereby allowing the overall flexibility of the bristle mount to increase, so as to enable the bristle mount to replicate a flexing of the body portion.

The overall relative flexibility of the bristle mount may, due to the use of flexible members, be greater than the flexibility of the body portion. This advantageously allows the bristle mount to readily mirror or substantially replicate the movement of the body portion with greater ease.

Such flexible members 124 are preferably positioned to extend from a vertex of an outwardly facing (i.e. away from the direction of the body portion) surface of the mount section 122, as this enables the greatest degree of movement of the mount section relative to a neighbouring or adjacent mount section. However, embodiments are not limited thereto, and the flexible members may connect adjacent mount sections by respective side edges of their outwardly facing surfaces.

Thus, in at least one embodiment, outwardly facing surfaces of the overall bristle mount may be thought to be substantially continuous, having at least one shaped aperture 129 positioned therethrough. The inwardly-facing surface of the overall bristle mount need not be substantially continuous, for example, the thickness of the flexible members may be less than the thickness of the connected mount sections (to increase the flexibility of the flexible members).

Mount sections (and thereby bristles mounted thereon) may be arranged into one or more rows. For example, a first plurality of mount sections may be considered as a first row 410, and a second plurality of mount sections, adjacent to the first, may be considered as a second, adjacent row 420. Mount sections in adjacent rows may be positioned alongside another, such that along the length of a row, each mount section is positioned to be adjacent to a mount section in a neighbouring row.

In embodiments, mounts sections in a row 410 may be alternately off-set from a centre line 415 spanning the length of that row. This advantageously allows for improved detangling, for examples, as different bristles along the row may be placed at different positions of an obstruction in hair.

Advantageously, all bristles in a row may be shorter in height than all bristles in an adjacent row. For example, first row 410 may comprise bristles which vary in height between around 10-13 mm, whereas bristles in the second row 420 vary in height between around 6-9 mm.

In at least one other embodiment, each bristle is of the same height. In other words, each bristle in each row projects outwardly from its respective mount section to the same extent.

In other or further embodiments, the bristles of each mount section in a row may have a uniform difference in size to a bristles of a respective and adjacent mount section in an adjacent row. In other words, there may be a uniform difference in size between bristles mounted on adjacent mount sections in different rows.

In some embodiments, the tips of bristles in the same row all lie in the same plane and, optionally, the tips of bristles in adjacent rows lie in different planes.

In some optional embodiments, the tips of every bristle of the hair brush lie in the same plane.

Mount sections may alternatively or additionally be arranged into one or more groups 121 of circularly arranged mount sections. That is to say, mount sections may be arranged so as to be positioned in a hypothetical circle around one another, such that a plurality of mount sections are positioned in a circle shape. This advantageously allows for an obstruction (e.g. knot or snag) in the hair to be encircled by bristles so as to increase the exposure of the obstruction to the bristles. This permits for an increased and improved manner detangling effect in removing obstructions in brushing the hair.

Figure 7:
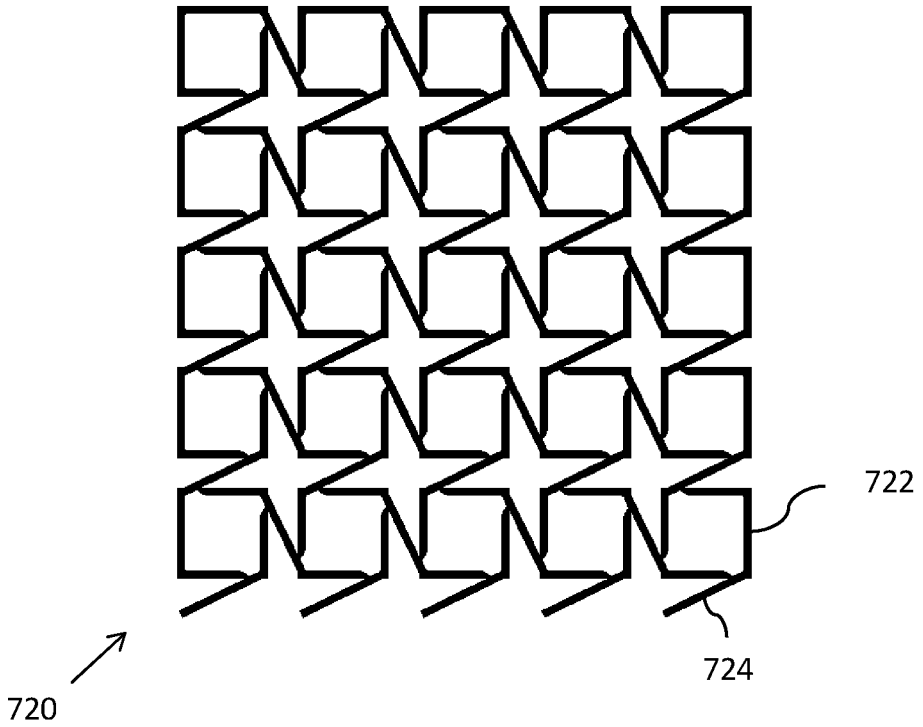
FIG. 7 illustrates a bristle mount of a hair brush according to a second embodiment of the invention.

The shape of each mount section 122 is not necessarily triangular, as in the first embodiment. For example, with reference to FIG. 7, which illustrates a bristle mount according to a second embodiment of the invention, a mount section 722 may be rectangular, for example, square.

Figure 8:
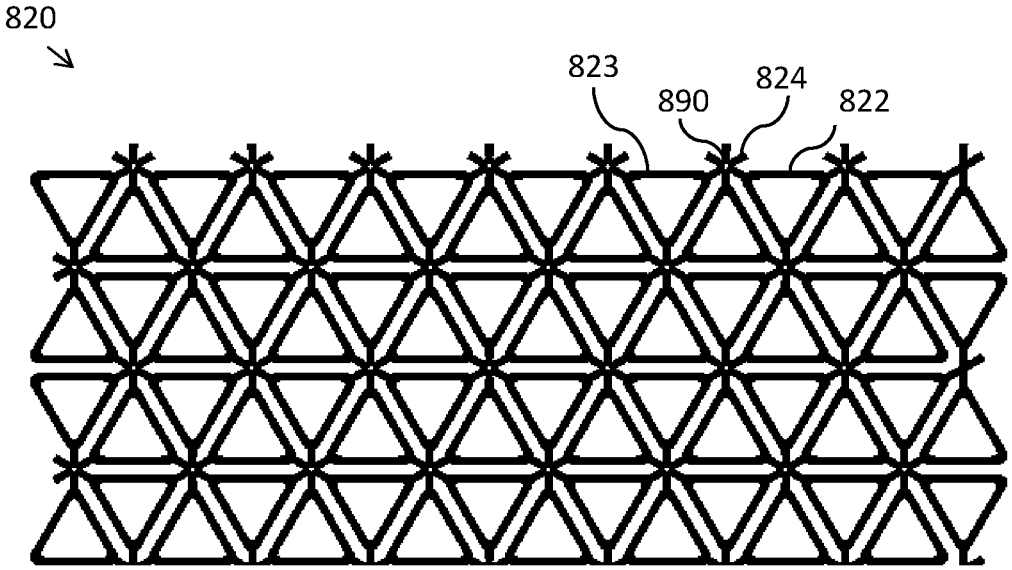
FIG. 8 illustrates a bristle mount of a hair brush according to a third embodiment of the invention.

With reference to FIG. 8, a bristle mount 820 according to a third embodiment of the invention may be described. As previously embodied, each mount section 822 is adapted to be positionable about one another.

Adjacent mount sections 822, 823 are connected by a flexible member 824 via an intermediary mount section 890. The provision of the intermediary mount section 890 allows for the mount sections 822, 823 to have a greater range of movement relative to another, as the intermediary mount section acts as an additional pivot joint about which the mount sections may move.

Figure 9:
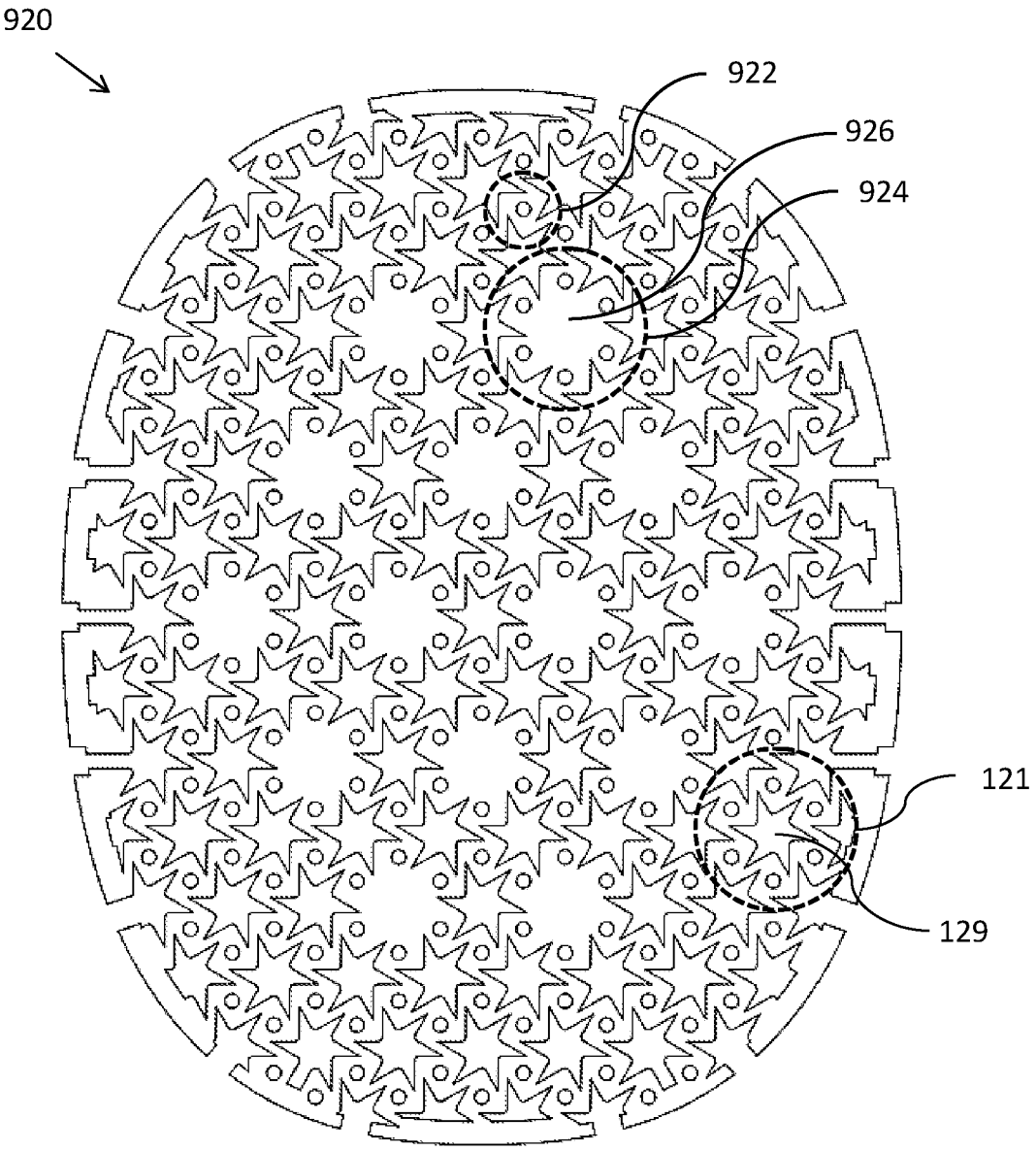
FIG. 9 illustrates a bristle mount of a hair brush according to a fourth embodiment of the invention.

With reference to FIG. 9, a bristle mount 920 according to a fourth embodiment of the invention may be understood, in which at least two mount sections are formed in different shapes and/or sizes. FIG. 9 depicts an underside of the bristle mount 920. Presently, there may be considered at least a first mount section 922 and a second mount section 924.

The first mount section 922 is formed in a substantially triangular shape. Put another way, the first mount section may be formed in a similar manner to the mount sections 122 of the bristle mount 120 according to the first embodiment.

The second mount section 924 is formed as a circular arrangement of a plurality of triangular shapes, wherein the triangular shapes are directly connected together such that no gap is present towards the centre of the circular arrangement. In other words, in some embodiments, a (former) gap 926 bounded by a circular arrangement of shapes may be filled in, such that circularly arranged shapes are directly connected together. Such a circular arrangement may be considered as analogous to the groups 121 of circularly arranged mount sections, in which further material bridges or fills the aperture 129 or gap defined by the group.

In other words, the second mount section 924 may be formed from a plurality of triangular mount portions 925 (each mount portion mounting a bristle thereon), wherein each mount portion 925 is directly connected to the other mount portions of the mount section 924. It may be otherwise considered that a gap between the mount portions in 'filled in' (e.g. with material of the bristle mount).

It will be apparent that any other shaped mount portions are conceived by the present invention, for example, square, circular or rectangular mount portions.

It will be seen that the bristle mount 920 according to the fourth embodiment (of the same size and having the same number of bristles) may have fewer shaped apertures 129 than the bristle mount 120 according to the first embodiment. In other words, in conceivable embodiments (such as this fourth embodiment) a number or selection of the shaped apertures 129 of the bristle mount 120 according to the first embodiment may be 'filled in' or no longer present.

It has been recognised that such an embodiment may be particularly advantageous in reducing a manufacturing overhead and complexity, as there is a reduction in the complexity of the design. Put another way, such an embodiment may better optimise the trade-off between a pattern and the manufacturing capabilities (e.g. injection moulding capabilities), thereby reducing an expense and energy expenditure of manufacturing.

In order to allow the first mount sections 922, 924 of the bristle mount 920 to be positionable about one another, each mount section may be connected to at least one neighbouring mount section by a flexible member. By way of example, the first mount member 922 may be connected to the second mount member 924 via a flexible member. The flexible member is adapted to be sufficiently flexible so as to allow the mount section 922, 924 to be angularly positioned about a neighbouring mount section.

In other words, a mount section may be flexibility connected to a neighbouring mount section by a beam or limb. Such a beam or limb is more flexible then the connected mount section, thereby allowing the overall flexibility of the bristle mount to increase, so as to enable the bristle mount to replicate a flexing of the body portion.

It will be apparent that different mount sections may mount a different number of bristles thereon. By way of example only, with reference to FIG. 9, a first mount section 922 may mount only a single bristle, whereas a second mount section 924 may mount six (or more) bristles. Conceivably, different mount sections may be formed from different materials. By way of example, the first mount section 922 may be formed from a material having a higher intrinsic flexibility, and the second mount section 924 may be formed from a material having a lower intrinsic flexibility. This would allow, for example, for a more adaptive and customizable hairbrush.

The flexibility of the hair brush advantageously allows for a variety of different hair brush configurations to be used. In other words, a hair brush according to at least one embodiment is advantageously more versatile than other hair brushes.

Figure 10A:
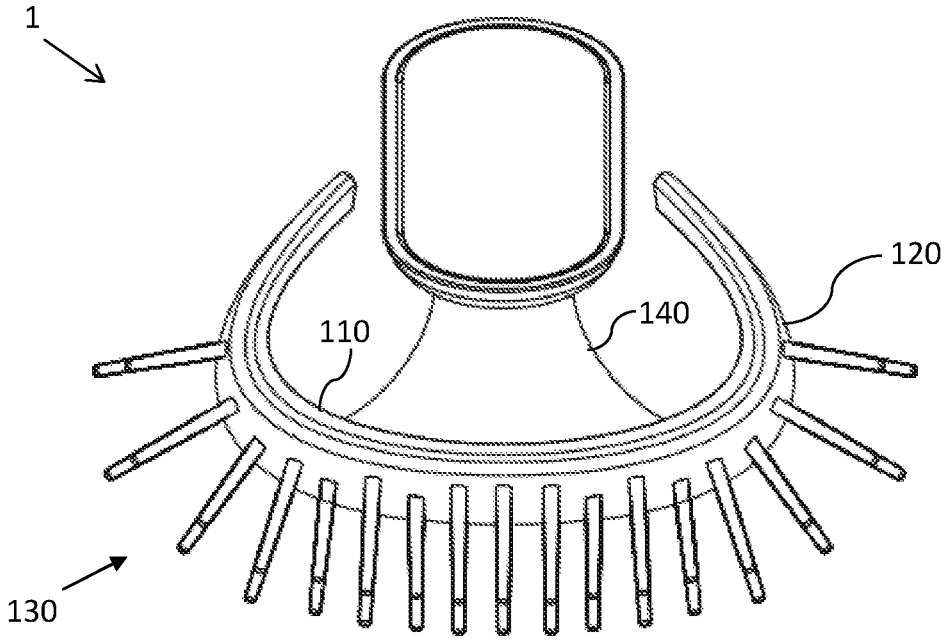
FIGS. 10A and 10B illustrate a hair brush according to an embodiment of the invention in an outwardly flexed configuration.
Figure 10B:
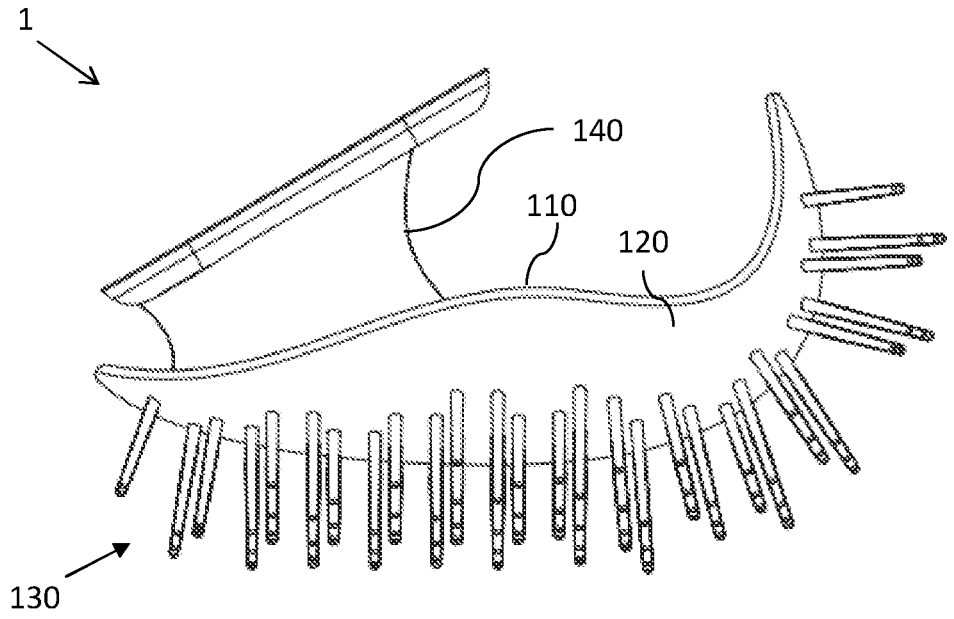

For example, with reference to FIGS. 10A and 10B, the hair brush may be outwardly flexed to have a bristle mount configuration that at least partially resembles a curling brush. Such a configuration may be advantageously used to enhance or encourage the curling of hair when brushed.

Figure 11A:
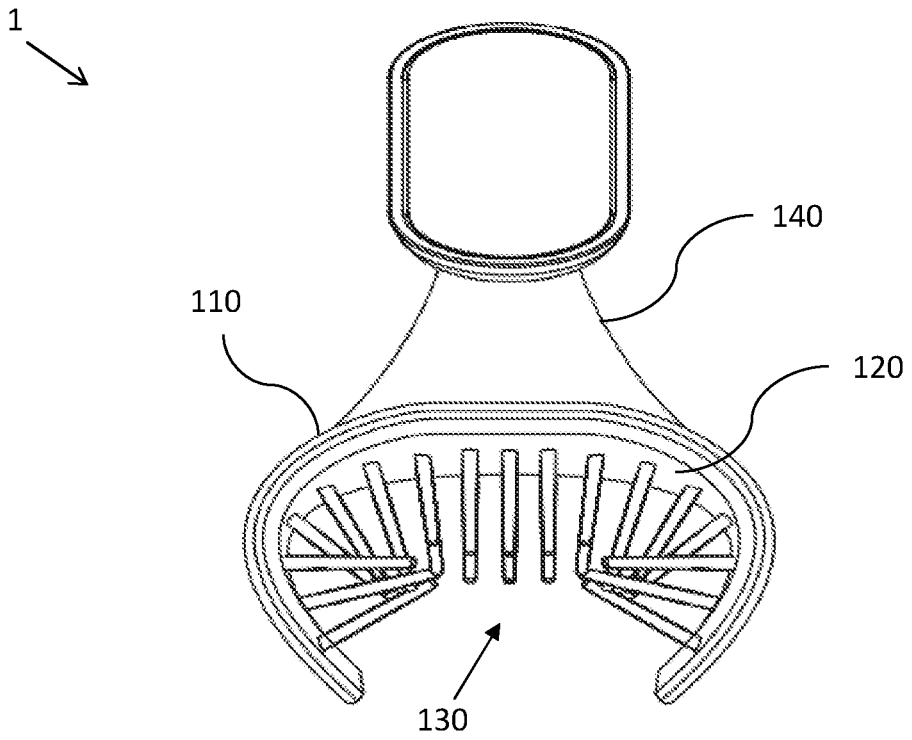
FIGS. 11A and 11B illustrate a hair brush according to an embodiment of the invention in an inwardly flexed configuration.
Figure 11B:
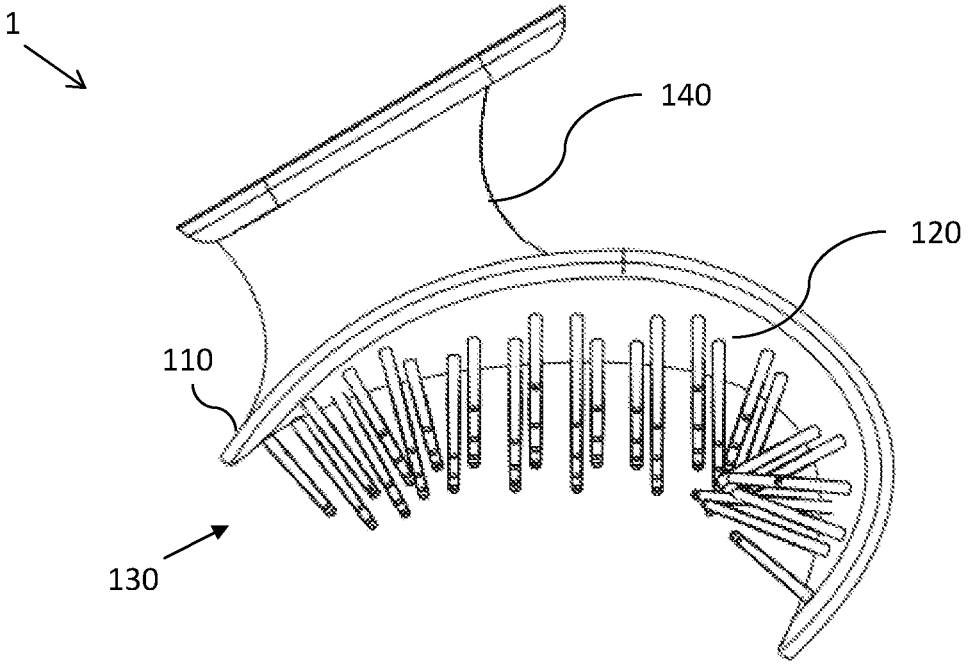

With reference to FIGS. 11A and 11B, in another configuration the hair brush may be inwardly flexed. This may allow the hair brush to more closely match the contours of a scalp or skin on which hair is positioned. This may allow, for example, for more hair to be brushed in a single continuous movement of the brush when compared to a conventional, non-flexible, brush, thereby improving the speed and efficacy of brushing hair.

It will be understood that the bristle mount need not comprise flexible members to connect mount sections together. For example, in other embodiments, each mount section may be individually connected by a flexible member directly to a surface of the body portion, such that the mount sections are not connected together. This allows for each mount section to have a degree of movement relative to the body portion and one another.

In some other embodiments, the bristle mount may comprise concentric rings formed from alternately rigid and less rigid material, wherein the bristles are mounted in the more rigid material (i.e. the concentric rings formed from the more rigid material are mount sections). The less rigid material connecting the more rigid rings together allows the concentric rings to be positioned about one another, so as to enable the flexing of the bristle mount about the more flexible body portion.

Other suitable materials for the body portion 110, bristle mount 120 and bristles 130 than herein disclosed will be well known to the person skilled in the art. For example, the body portion may comprise silicone; thermoplastic elastomer, rubber; and/or elastomer. The bristle mount and/or bristles may comprise, for example: thermoplastic elastomer, nylon and thermoplastic.

The body portion, bristle mount and bristles may be formed, for example, in an injection moulding process and/or a 3D printing process. In some embodiments, the body portion is overmoulded onto the bristle mount.

The hair brush as herein described may be used in any situation where it is desirable for hair (including artificial hair, for example, wigs) is brushed, for example, brushing the hair of an individual's head or brushing the fur or coat (e.g. pelage) of an animal.

Although embodiments above describe and relate to a palm-held hair brush, it will be readily apparent that the hair brush may comprise an elongated handle (e.g. connected to the body portion) which may be held by a user. A user may, for example, be able to grip the elongated handle with a single hand so as to hold the hair brush solely by the elongated handle. In other words, a user may hold a hair brush only by gripping a protrusion of the hair brush in a fist-like configuration. This may provide, for example, an improved level of control over placement of the hair brush and speed of brushing.

In other configurations, a user may hold a hair brush in a palm of a hand and in a fist-like configuration. In other words, a user may hold an elongated handle with a first hand in a fist-like manner, and grip the body portion in a palm of a second hand such that the body portion rests against a user's palm. Such a hair brush will be readily understood by the skilled person to be at least partially palm-held.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A hair brush comprising:

a body portion formed from a material having a first flexibility; and a bristle mount formed from a material having a second flexibility that is less than the first flexibility and coupled to the body portion, the bristle mount comprising a plurality of mount sections supporting a plurality of bristles, wherein each mount section of the plurality of mount sections has at least one bristle mounted thereon; and a plurality of flexible members connecting the plurality of mount sections, wherein each flexible member of the plurality of flexible members spans a gap between a different pair of mount sections of the plurality of mount sections, and each mount section not arranged at a perimeter of the bristle mount is coupled to at least three other mount sections of the plurality of mount sections by flexible members of the plurality of flexible members;

wherein the mount sections are movable relative to one another in three dimensions and enable the bristle mount to substantially replicate bending or flexing of the body portion.

2. The hair brush of claim 1 wherein:

the plurality of mount sections are arranged into at least one row;

each mount section comprises an outwardly facing surface area, the outwardly facing surface area being an area of the mount section upon which the at least one bristle is mounted, wherein each outwardly facing surface area is similarly shaped; and outwardly facing surface areas of mount sections in the same row are alternately oriented.

3. The hair brush of claim 2 wherein:

the plurality of mount sections are arranged into a plurality of rows, each row comprising multiple mount sections;

neighboring mount sections in the same row are connected by a flexible member; and each mount section in a row is connected to at least one mount section in a neighboring row.

4. The hair brush of claim 3 wherein:

the outwardly facing surface area of each mount section is substantially triangular; and each flexible member extends from a respective vertex of the outwardly facing surface area.

5. The hair brush of claim 1 wherein each bristle in the plurality of bristles is formed from a material having a third flexibility, the third flexibility being less than or equal to the second flexibility.

6. The hair brush of claim 1 wherein the bristles are formed together with the bristle mount such that the bristles are formed from the same material as the bristle mount.

7. The hair brush of claim 1, wherein the plurality of bristles comprises groups of at least one bristle, wherein the tips of bristles in a same respective group lie in the same plane and the tips of bristles in different groups lie in different planes.

8. The hair brush of claim 1 wherein:

the body portion comprises at least one of the following materials: silicone, thermoplastic elastomer, rubber, and elastomer; and the bristle mount comprises at least one of the following materials: thermoplastic elastomer, nylon, and thermoplastic.

9. The hair brush of claim 1, wherein the body portion is formed so as to allow the hair brush to rest against a user's palm, thereby enabling the hair brush to be palm-held.

10. The hair brush of claim 9, wherein the body portion further comprises a gripping protrusion, the gripping protrusion having a profile shaped to fit between a user's fingers when the body portion rests against the user's palm.

11. The hair brush of claim 9, wherein the body portion further comprises a first shaped area and a second shaped area, the first shaped area being adapted to have a profile to fit the user's thumb when the body portion rests against the user's palm, the second shaped area having a profiled adapted to fit the user's finger when the body portion rests against the user's palm.

12. The hair brush of claim 1, wherein each flexible member of the plurality of flexible members is more flexible in bending than each mount section of the plurality of mount sections.

13. The hair brush of claim 1, wherein each mount section not arranged at a perimeter of the bristle mount is coupled to exactly three other mount sections of the plurality of mount sections by flexible members of the plurality of flexible members.

14. The hair brush of claim 13, wherein for each mount section not arranged at a perimeter of the bristle mount, the mount section is in contact with three flexible members oriented one hundred twenty degrees apart.

15. The hair brush of claim 13, wherein for each mount section not arranged at a perimeter of the bristle mount, the mount section is triangular in shape.

16. The hair brush of claim 1, wherein each flexible member of the plurality of flexible members has a thickness that is less than a thickness of each mount section of the plurality of mount sections.

17. The hair brush of claim 1, wherein each flexible member of the plurality of flexible members has a width that is less than a width of each mount section of the plurality of mount sections.

18. The hair brush of claim 1, wherein the plurality of mount sections is substantially planar.

* * * * *